US007150903B2

(12) United States Patent
Frey

(10) Patent No.: US 7,150,903 B2
(45) Date of Patent: Dec. 19, 2006

(54) CORRUGATED PAPERBOARD INCLUDING TEAR LINE

(75) Inventor: Albert O. Frey, Dirlewang-Helchenried (DE)

(73) Assignee: Albert Frey Verpackungsentwicklungen und Vertriebs GmbH, Mindelheim (DE)

( * ) Notice: Subject to any disclaimer, the term of this patent is extended or adjusted under 35 U.S.C. 154(b) by 0 days.

(21) Appl. No.: 10/462,978

(22) Filed: Jun. 16, 2003

(65) Prior Publication Data

US 2004/0071940 A1 Apr. 15, 2004

(30) Foreign Application Priority Data

Jun. 17, 2002 (DE) ..... 102 27 050

(51) Int. Cl.
*B65D 17/00* (2006.01)
*B65D 65/28* (2006.01)

(52) U.S. Cl. ..... 428/43; 428/182; 229/207

(58) Field of Classification Search ..... 428/43, 428/156, 167, 182, 184, 542.8; 229/87.05, 229/101.1, 207, 235, 239
See application file for complete search history.

(56) References Cited

U.S. PATENT DOCUMENTS 3,863,834 A * 2/1975 Sandford ..... 428/43
4,008,849 A * 2/1977 Baber ..... 229/237
5,464,151 A * 11/1995 Parker et al. ..... 229/206

FOREIGN PATENT DOCUMENTS

| | | |
|---|---|---|
| DE | 83 15 038 | 9/1983 |
| DE | 693 00 351 T2 | 11/1993 |
| DE | 44 28 185 A1 | 2/1996 |
| DE | 197 05 533 C2 | 8/1997 |
| EP | 0571197 A1 * | 11/1993 |
| GB | 777079 | 6/1957 |

OTHER PUBLICATIONS

Norbert Troster, "Retailer's Recommendations for Recyclable Solid-fibre and Corrugated Cardboard Transport Packaging", 30 pages, no date.
EHI Research, Information, Consultancy; International Network for the Retail Industry and its Partners, 10 pages, no date.

* cited by examiner

*Primary Examiner*—Donald J. Loney
(74) *Attorney, Agent, or Firm*—Dorsey & Whitney LLP

(57) ABSTRACT

In single-wall corrugated paperboard comprising corrugating medium joined on both sides to two liners and a tear line along which the corrugated paperboard can be torn open, the two liners are severed directly opposite each other, whilst the corrugating medium has no incision, or merely in the region of of the flute peaks, the tear line being configured straight or curved. This system results in the structural integrity of the corrugated paperboard being hardly detrimented. In the tearing open action the cut liners act as knife edges which cleanly sever the corrugating medium at the defined locations, producing neat cut edges of pleasing visual appeal.

9 Claims, 5 Drawing Sheets

CORRUGATED PAPERBOARD INCLUDING TEAR LINE

RELATED APPLICATION

This application claims priority to German Application Ser. No. 102 27 050.3 filed Jun. 17, 2002.

BRIEF DESCRIPTION OF THE INVENTION

The invention relates to single-wall corrugated paperboard comprising a corrugating medium joined on both sides to two liners and including a tear line, along which the corrugated paperboard can be torn open, the two liners being incised along the tear line on both sides.

BACKGROUND OF THE INVENTION

Corrugated paperboard is a material used for many different shipping containers, wrap cartons and, more recently, for display shippers. In addition to shipping protection these containers need to satisfy many further requirements. One of these is that the containers must permit simple, reliable, safe and easy opening. For this purpose conventional corrugated paperboard features perforations or slits along the tear line. In part, these perforations are backed by an underbonded tear thread of tear-resistant material to render tearing open more reliable.

Known from DE 197 05 533 is an assembly for configuring a tear line for solid and compacted paperboard scored on both sides staggered by a few millimeters. When torn open, the paperboard tears in the medium plane between the troughs of the score lines. This method cannot be translated for use on corrugated paperboard since no homogenous material is involved.

GB 777,079 discloses a single-wall corrugated paperboard with tear lines, proposing as an alternative full-length incisions made only in the liners (i.e. without severing the liners completely) or a discontinuous perforation which fully perforates the liners, however. In any case, the tear lines on both sides are spaced away from each other resulting in an unsightly tear edge when torn open.

DE 693 00 351 T2 discloses a tear means for corrugated paperboard comprising a tear band and weakening lines on both sides of the tear band facing further weakening lines provided on the backing face medium. Such a system has some serious drawbacks. Thus, the system is unduly complicated not permitting round or curved tear lines to be implemented due to the plastics tear band being bonded to the carton blank. Apart from this, the freedom in designing the arrangement of the tear line is seriously restricted because of its straight-line requirement.

Known tear-open systems fail to satisfy the requirements for a container which is simple to open with no restrictions as to its structural integrity. The reason for this is that need to weaken the material of the corrugated paperboard to facilitate opening runs counter technically to the need to maintain structural integrity as required for protection in shipping. All known systems attempt to find a go-between to these contradicting requirements.

This is reflected, for example, by the German publication relating to solid and corrugated paperboard shipping cases or containers published by the European Institute of Trade (EHI) where it reads on page 13 that all of these conventional systems are unsatisfactory (unsuitable). On page 30 of this publication dating back to the year 1998 it reads that cartons having perforations are time-consuming in being opened and prompt personnel to risk making use of knives, often with serious damage to the packaged articles.

OBJECTS AND SUMMARY OF THE INVENTION

It is thus the objective of the present invention to configure the tear line of a generic corrugated paperboard for facilitated fabrication thereof in eliminating the need for a tear band so that the corrugated paperboard is easily and reliably opened at the locations provided therefor without substantially detrimenting the necessary structural integrity of the corrugated paperboard whilst forming neat, smooth tear edges on being torn open.

In other words, the invention is intended to maintain the structural integrity of the corrugated paperboard for ensuring high efficiency in packaging and serving to safeguard the packaged articles during shipping whilst permitting facilitated and reliable opening at defined locations, namely along the defined tear line, with the latter more particularly exhibiting neat edges after opening in preventing cutting injuries and making for visual appeal. Visual appeal is particularly important in the case of of display shippers, i.e. corrugated paperboard cases designed for presentation of the articles as shelved for sale, for example, in supermarket sales outlets.

The objective of the invention is achieved by a single-wall corrugated paperboard comprising a corrugating medium joined on both sides to two liners and including a tear line along which the corrugated paperboard can be torn open, the two liners being incised along the tear line on both sides, characterized in that the cuts sever the two liners at least to 50% whilst the corrugating medium has no incision, or merely in the region of the flute peaks and the cuts in the two liners are opposite to each other configured straight or curved.

Advantageous further embodiments of the invention are directed to corrugated paperboard in which; (a) the cuts in the two liners are directly opposite each other; (b) the cuts in the two liners are staggered by not more than 1.5 mm: (c) the cuts in the two liners sever same to 80 to 100%; (d) an angle between tear line and fluting direction exceeds 70° and the liners are fully severed and the cutting depth in the corrugating medium on both sides amounts to 5% of the spacing between the two liners; (e) an angle between tear line and fluting direction from 30° to 70° the cutting depth in the corrugating medium on both sides amounts to 10% of the spacing between the two liners; (f) an angle between tear line and fluting direction exceeds 75° and the cutting lines are configured wavy; and (g) the tear line comprises a plurality of line portions each having a different angle between tear line and the fluting direction and depth and line shape of cut differing depending on the angle involved.

Now that in accordance with the invention only the liners are severed facing each other whilst the corrugation has no incision or merely unsubstantially (along the flute peaks or troughs) there is no longer hardly any degradation to the structural integrity of the corrugated paperboard. On being torn open, the cut liners have the effect of knife edges shearing the corrugating medium cleanly and without crumbling at the defined locations to make for cut edges of neat visual appeal. In this arrangement the corrugating medium is severed between the upper liner on the one side and the lower liner on the other.

In other words, the invention serves to maintain the structural integrity of the corrugated paperboard in ensuring high efficiency in packaging and serving to safeguard the packaged articles during shipping whilst permitting facilitated and reliably opening at defined locations, namely along the defined tear line, with the latter more particularly exhibiting neat edges after opening in preventing cut injuries and making for visual appeal. Visual appeal is particularly important in the case of display shippers, i.e. corrugated paperboard cases designed for presentation of the articles as shelved for sale, for example, in supermarket sales outlets.

It is of advantage when the liners are completely severed. Any lesser cutting depth in the liners or when opposing cuts in the liners are staggered by more than 1.5 mm fails to ensure the special function in the tear edges acting as shear edges which, as a rule, results in unclean cut edges.

In accordance with the invention the cutting depth can be selected so that the cut not only fully severs the liners but also slightly nicks the corrugating medium, resulting in it being slightly incised along the flute peaks. The cutting depth should preferrably be not more than 5% of the spacing between the two liners to avoid any significant weakening in the structural integrity. "Corrugating medium" in this context is intended to cover both single and multi-ply medium.

As an alternative it is also possible to select the cutting depth so that the cut does not sever the liners, but only to more than 50%, preferably more than 80% without nicking the corrugating medium. In this arrangement the cutting effect in accordance with the invention is not as good as when the liners are fully severed and thus the tear edges fail to be correspondingly smooth. But the strength of the corrugated paperboard in the region of the cuts is somewhat better than with deeper cuts, especially when these cuts even nick the corrugating medium.

Preferably the cuts in the two liners directly face each other relative to the plane of the corrugated paperboard. A stagger of up to 1.5 mm, better less than 0.5 mm between the upper and lower facing cuts still achieves the advantageous effects of the invention to a limited extent. Any greater stagger ruins the cutting effect and instead the corrugating medium is simply ripped, resulting in unsightly edges.

The results in accordance with the invention are best when the tear line is oriented more or less perpendicular to the fluting direction. In this context, "fluting direction" is understood to be the direction in which the corrugating medium runs straight. The smaller the angle between tear line and fluting direction the stronger the negative effect of the fiber direction of the corrugating medium has on the visual appeal of the severed edge.

This is compensated by increasing the cutting depth and thus in increasing the incision in the flute peaks in accordance with an advantageous aspect of the invention, as long as the angle between the tear line and the fluting direction is greater, more particularly exceeding approximately 30 degrees. This results in tear lines even for curves causing no problem, and this reliably translates highly complex curved tear mechanisms as needed in highlighting the sales promotion aspect of display shippers, as cited for example in DE 197 05 533, to corrugated paperboard. As compared to the method as described in EP 571 197 B1 employing a back bonded tear band the invention has the advantage that so-called stadium style display shippers, i.e. with rising sidewalls or high-backed, can now be achieved.

With an even smaller angle between tear line and fluting direction, preferably smaller than 30 degrees as provided for in another advantageous aspect of the invention, the cutting line is configured wavy, either by a wavy cut or by using wavy ground knives, resulting in the cutting depth being maintainable within acceptable limits.

The deeper the cut and thus the incision in the corrugating medium, the lower is the force needed to tear open the corrugated paperboard. This force diminishes proportionally to the increase in the cutting depth, whilst the relative weakening of the stiffness increases proportionally to a corresponding degree. This is because with increasing cutting depth the length of the severed corrugating medium is diminished proportionally, but the portions of the fluting structure particularly important for the stiffness of the corrugated paperboard having a greater angle of attack are not severed until a deeper cut is achieved. The result of this is that when the flute peaks are lightly nicked, the structural integrity of the corrugated paperboard is diminished only relatively slightly, but significantly improving the ease in tearing open the corrugated paperboard.

The longer the fibers in the liners as compared to the corrugating medium, the easier it is to tear open the corrugated paperboard. On the other hand, the stiffness of the corrugated paperboard provided with a tear line is least reduced relatively when the fibers in the corrugating medium are longer than those of the liners.

BRIEF DESCRIPTION OF THE DRAWINGS

The invention will now be detained by way of example embodiments with reference to the attached drawings in which.

DESCRIPTION OF THE PREFERRED EMBODIMENTS

Figure 1:
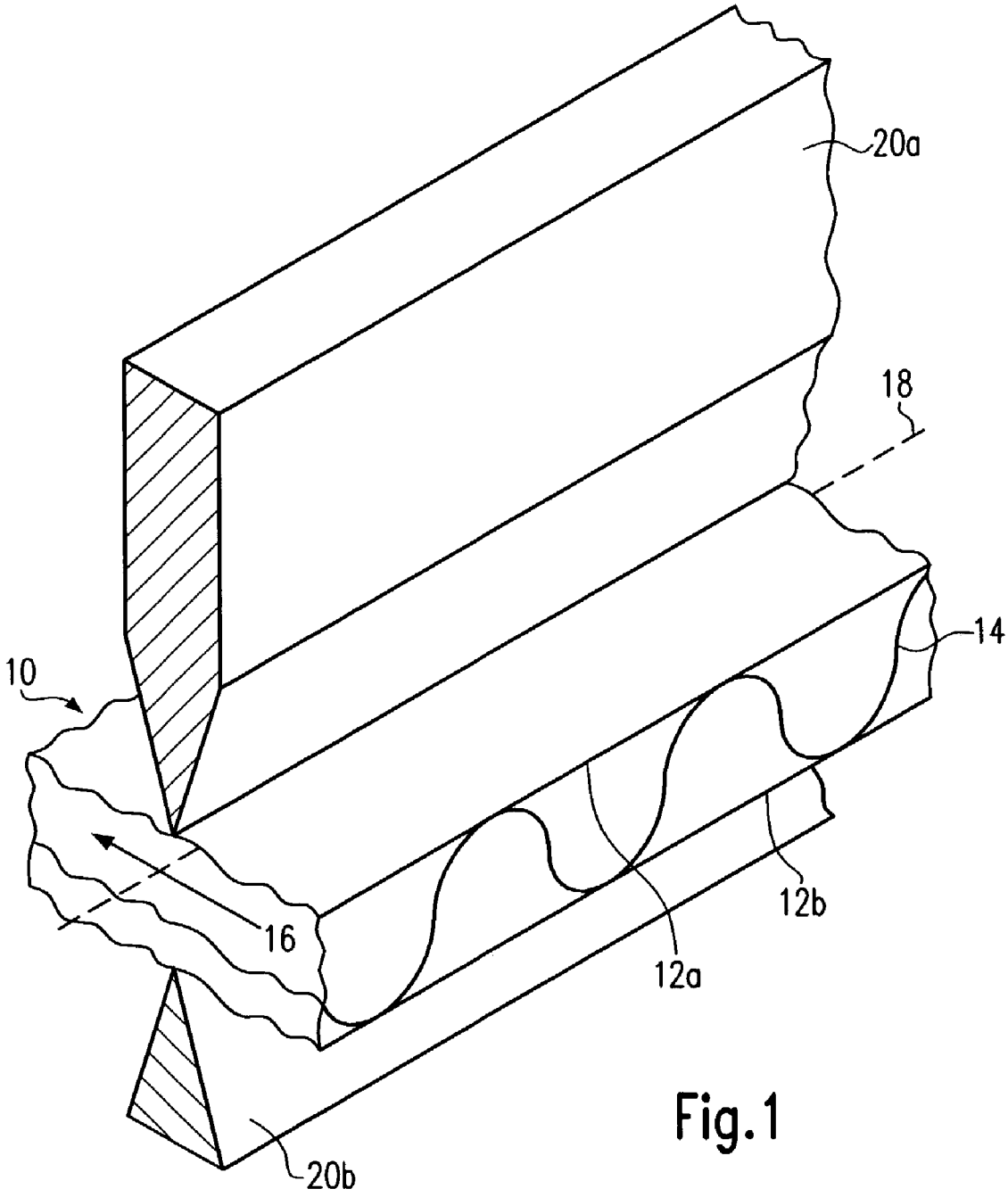
FIG. 1 is a diagrammatic view in perspective of corrugated paperboard in accordance with the invention during cutting.

Referring now to FIG. 1 there is illustrated in perspective a corrugated paperboard 10 comprising an upper liner 12*a* and a lower liner 12*b* sandwiching a corrugating medium 14 glued to the two liners 12*a*, 12*b*. In the fluting direction 16 the corrugating medium 14 is configured straight and perpendicular thereto corrugated. As evident from FIG. 1 the tear line 18 along which the corrugated paperboard is to be later torn open, is configured by the liners 12*a*, 12*b* being severed by means of two knives 20*a*, 20*b*, the two cuts being located one above or opposite one another relative to the plane of the corrugated paperboard, i.e. non-staggered.

Figure 2A:
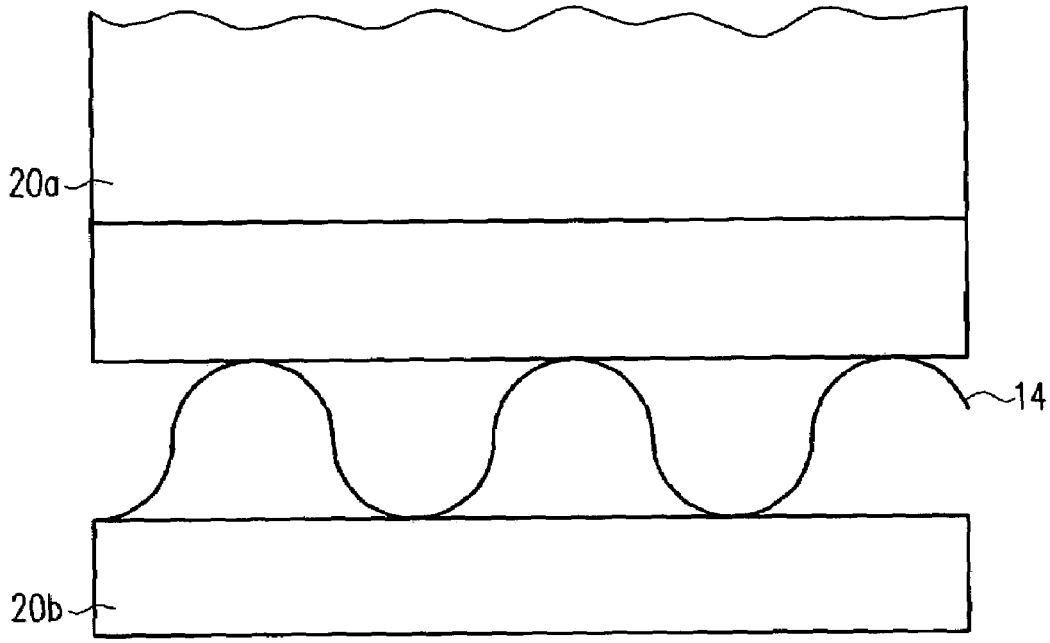
FIG. 2*a*, 2*b* are a diagrammatic side view of the cutting action as shown in FIG. 1.
Figure 2B:
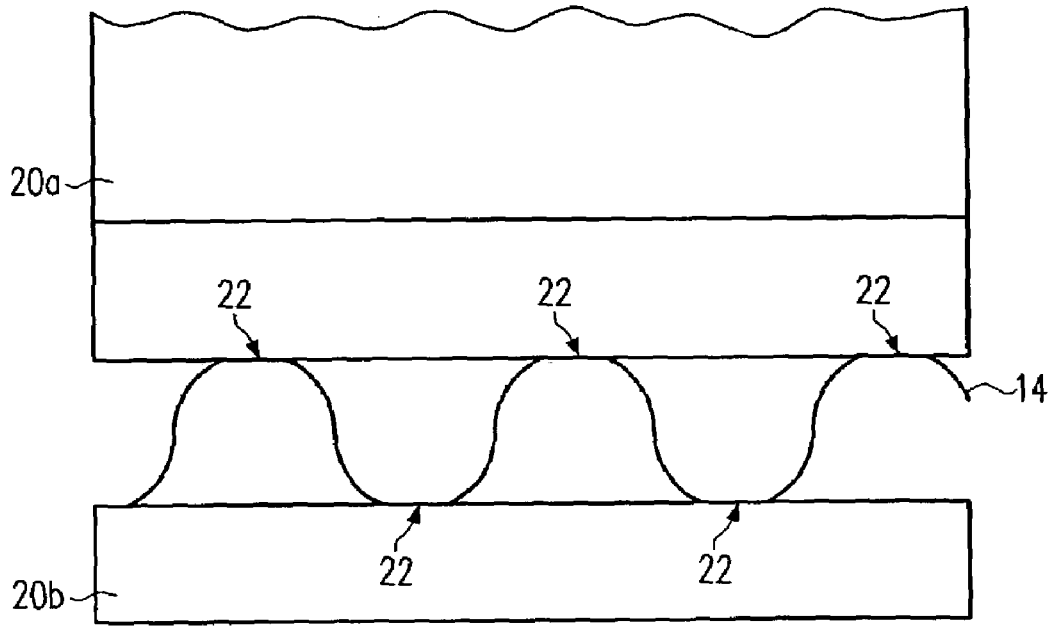

Referring now to FIGS. 2*a* and 2*b* there is illustrated how by means of the knives 20*a*, 20*b* either only the liners are severed without involving the corrugating medium 14 (FIG. 2*a*) or, however, how the corrugating medium 14 too is nicked in the region of the flute peaks 22 (FIG. 2*b*).

Figure 3:
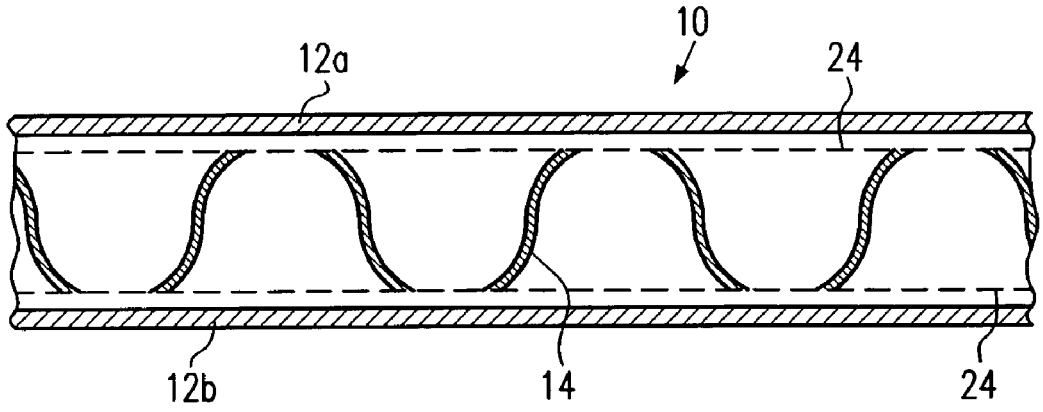
FIG. 3 is a section view of the corrugated paperboard with the corrugating medium nicked.

Referring now to FIG. 3 there is illustrated on a magnified scale to what extent the corrugating medium 14 is nicked in accordance with the invention. The cutting depth 24 amounts on each side preferably to not more than 5% of the spacing of the two liners 12*a*, 12*b*, i.e. the thickness of the corrugated paperboard 10. Along the cutting lines the corrugating medium 14 thus exists only in fragments which, however, results in no significant reduction in stiffness and strength when the cutting depth is small.

Figure 4:
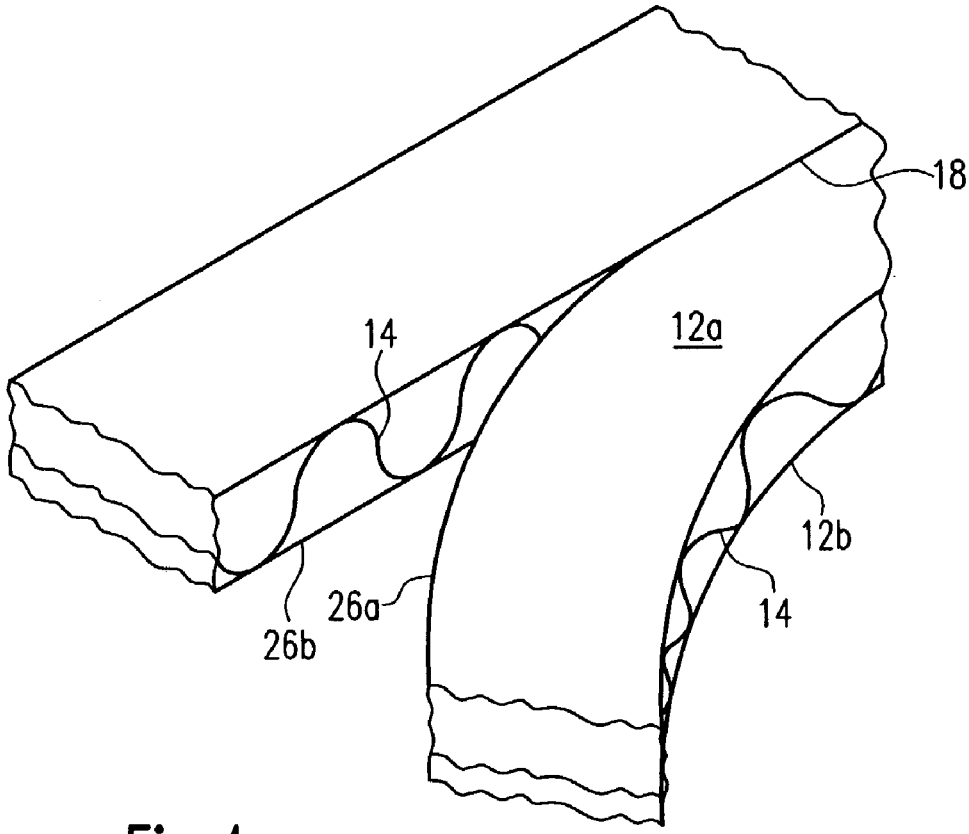
FIG. 4 is a view of the corrugated paperboard being torn open.

Referring now to FIG. 4 there is illustrated as a diagrammatic view in perspective the tearing open action in which the corrugated paperboard 10 is torn open along the tear line 18 that is simultaneously the cut in the upper liner 12*a*. In this arrangement the resulting tear edges simultaneously function as shear edges 26*a*, 26*b* for ensuring that the corrugating medium 14 is severed neat and smooth. This function is assured especially when the two liners 12*a*, 12*b* are fully severed, otherwise no sharp edged shear edges can form when the liners themslves first need to be torn in part.

Figure 5:
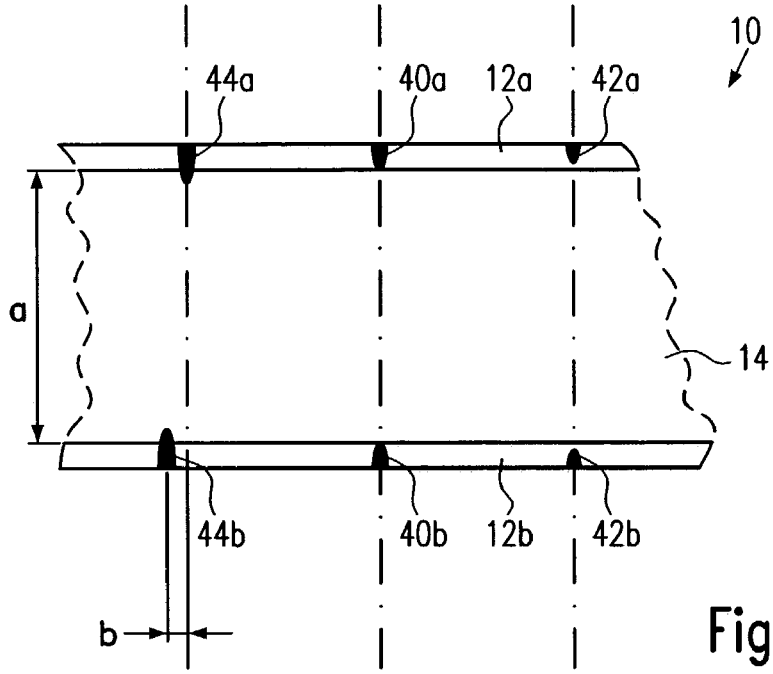
FIG. 5 is an illustration of three variants of incisions in corrugated paperboard.

Referring now to FIG. 5 there is illustrated as the invention three cut variants in a corrugated paperboard 10 wherein to make for a better appreciation the thicknesses of the two liners 12*a*, 12*b* are depicted magnified as compared to the lengthwise extension of the corrugating medium 14. The first cuts 40*a*, 40*b* sever the liners 12*a*, 12*b* to 100% without incising the corrugating medium 14 to any appreciable extent. The second cuts 42*a*, 42*b*incise the liners 12*a*, 12*b* to approximately 60% without nicking the corrugating medium 14. The third cuts 44*a*, 44*b* fully sever the liners 12*a*, 12*b*, the corrugating medium 14 being incised to approximately 10% (the spacing "a" between the liners 12*a*, 12*b*). In addition, the third cuts 44*a*, 44*b* are staggered by "b" amounting to less than 1.5 mm.

Figure 6:
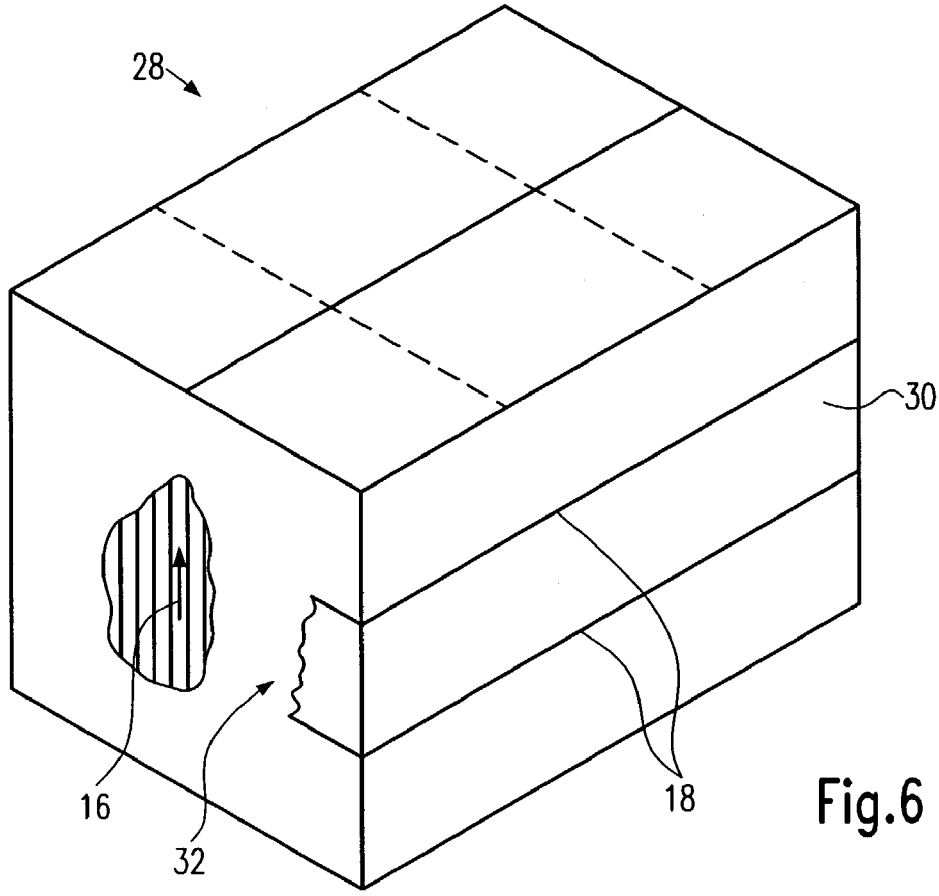
FIG. 6 is an illustration showing an example application of the corrugated paperboard for a first packaging carton.

Referring now to FIG. 6 there is illustrated as a diagrammatic view in perspective an example application for case or container 28 showing the fluting direction 16 of the corrugated paperboard (in the direction of the arrow or lines). This case 28 comprises a tear tab 30 formed by the tear line 18 on all sides, as a result of which the tear line 18 can be configured so that the tear tab 30 is removable without the aid of a knife, and the like, in producing neat, smooth tear edges. In the portion in which the tear line 18 runs parallel to the fluting direction 16 instead of the straight tear line a wavy tear line 32 may find application. At angles from 0° to 90° the cut may be deeper than in the portions in which the tear line 18 runs perpendicular to the fluting direction 16.

Figure 7:
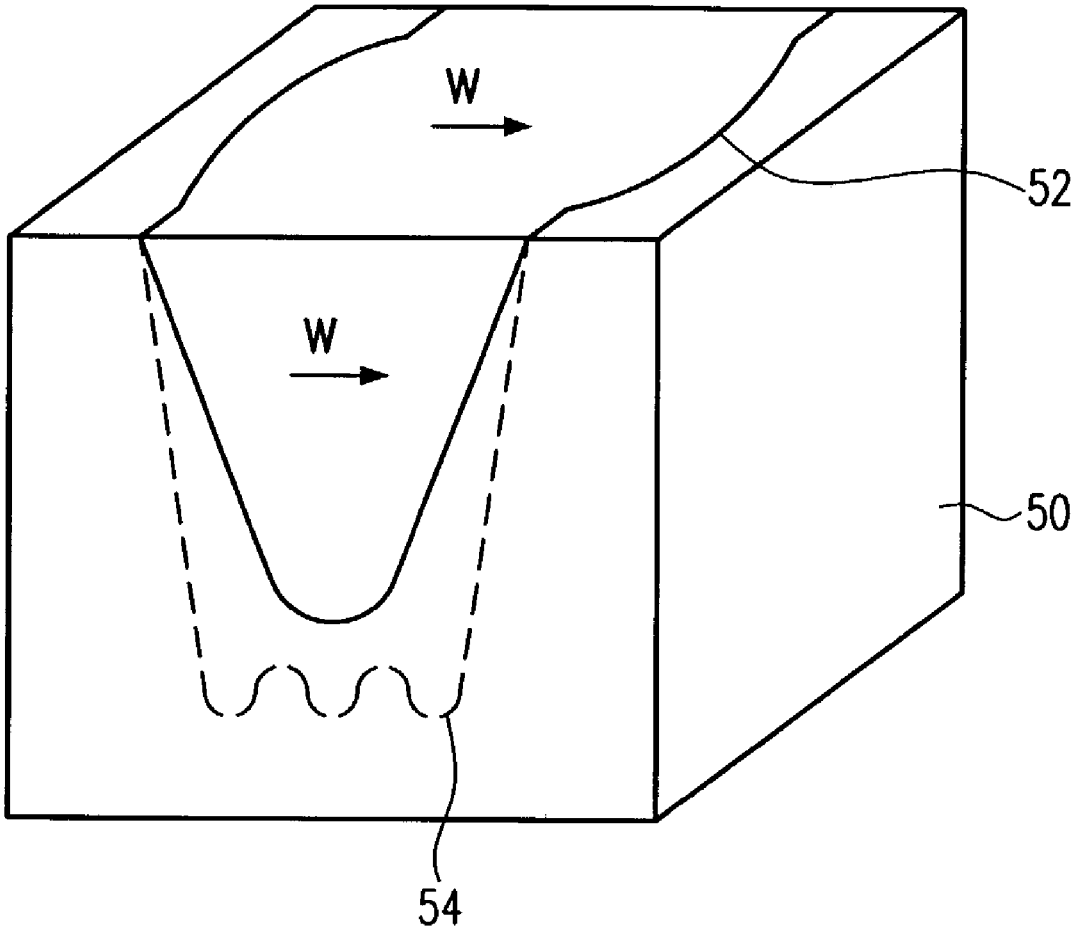
FIG. 7 is an illustration showing an example application of the corrugated paperboard for a second packaging carton.

Referring now to FIG. 7 there is illustrated yet another example application of the invention for a wrap carton 50 in which the fluting direction of the corrugating medium is indicated by the arrows w. Shown in FIG. 7 is the cutting line 52 which may be shaped almost in any way in running straight or curved.

Should the cutting line run parallel to the fluting direction w (indicated by the broken line) a wavy cutting line 54 may prove expedient to achieve a medium weakening of the corrugation structure whilst where a straight cutting line is involved the corrugating medium may be provided greatly weakened or not at all depending on the corrugation structure in the cutting line.

What is claimed is:

1. A tear-line assembly for single-wall corrugated paperboard consisting of a corrugating medium joined on both sides to two liners and including a tear line along which the corrugated paperboard can be torn open, said two liners being incised along said tear line on both sides, characterized in that the cuts sever said two liners at least to 50% whilst said corrugating medium has no incision and said cuts in said two liners are opposite to each other configured straight or curved such that said two liners separate the corrugated paperboard during the tearing procedure.

2. A tear-line assembly as set forth in claim 1, characterized in that said cuts in said two liners are directly opposite each other.

3. A tear-line assembly as set forth in claim 1, characterized in that said cuts in said two liners are staggered by not more than 1.5 mm.

4. A tear-line assembly as set forth in claim 1, characterized in that said cuts in said two liners sever same to 80 to 100%.

5. A tear-line assembly as set forth in claim 1, characterized in that at an angle between tear line and fluting direction exceeding 75° said cutting lines are configured wavy.

6. A tear-line assembly as set forth in any one of the claims 1, 2, 3, 4, and 5, characterized in that said tear line comprises a plurality of line portions each having a different angle between tear line and said fluting direction and depth and line shape of cut differing depending on the angle involved.

7. A tear-line assembly as set forth in claim 1, characterized in that at an angle between tear line and fluting direction exceeding 70° said liners are fully severed and the cutting depth in said corrugating medium on both sides amounts to 5% of the spacing between said two liners.

8. A tear-line assembly as set forth in claim 1, characterized in that at an angle between tear line and fluting direction from 30° to 70° the cutting depth in said corrugating medium on both sides amounts to 10% of the spacing between said two liners.

9. A single-wall corrugated paperboard juncture consisting of a corrugating medium joined on both sides to two liners and including a tear line along which the corrugated paperboard can be torn open, said two liners being incised along said tear line on both sides, characterized in that the cuts sever said two liners at least to 50% whilst said corrugating medium has no incision, and said cuts in said two liners are opposite to each other configured straight or curved such that said two liners separate the corrugated paperboard during the tearing procedure.

* * * * *